US007980234B2

(12) United States Patent
Saito

(10) Patent No.: US 7,980,234 B2
(45) Date of Patent: Jul. 19, 2011

(54) BLOW-BY GAS REDUCING DEVICE

(75) Inventor: Yasuhiro Saito, Aichi-ken (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 500 days.

(21) Appl. No.: 12/175,023

(22) Filed: Jul. 17, 2008

(65) Prior Publication Data

US 2009/0107425 A1 Apr. 30, 2009

(30) Foreign Application Priority Data

Oct. 24, 2007 (JP) ..... 2007-276993

(51) Int. Cl.
*F01M 13/00* (2006.01)

(52) U.S. Cl. ..... 123/572; 123/196 R

(58) Field of Classification Search ..... 123/572–574, 123/41.86, 196 R, 196 CP, 195 A
See application file for complete search history.

(56) References Cited

U.S. PATENT DOCUMENTS 6,148,807 A * 11/2000 Hazen ..... 123/572
6,877,494 B2 * 4/2005 White et al. ..... 123/572
7,051,721 B2 * 5/2006 Tomita et al. ..... 123/572
7,165,541 B2 * 1/2007 Hommes ..... 123/572

FOREIGN PATENT DOCUMENTS

JP 8-240113 A 9/1996

OTHER PUBLICATIONS

English language Abstract and machine translation of JP 8-240113 A.

* cited by examiner

*Primary Examiner* — M. McMahon
(74) *Attorney, Agent, or Firm* — Greenblum & Bernstein, P.L.C.

(57) ABSTRACT

The present invention provides a blow-by gas reducing device capable of adopting an exhaust pump with a small discharge rate and capable of suppressing oil degradation by reducing the mixing of bubbles in oil. The device includes: an oil pan of an engine; an oil tank; a first communication passage (an oil passage) connecting the oil tank and an oil holding portion of the oil pan; an oil pump (an exhaust pump) being provided in the first communication passage and pressure-feeding oil in the oil holding portion to the oil tank; a second communication passage (a gas passage) connecting the oil tank and a blow-by gas residing portion of the engine; and a gas sending device (a gas mechanism) utilizing a flow force of the oil inside the first communication passage to send blow-by gas in the blow-by gas residing portion to the oil tank via the second communication passage.

20 Claims, 2 Drawing Sheets

BLOW-BY GAS REDUCING DEVICE

BACKGROUND OF THE INVENTION

1. Field of the Invention

The present invention relates to a blow-by gas reducing device. More specifically, the present invention relates to a blow-by gas reducing device capable of adopting an exhaust pump with a small discharge rate and capable of suppressing oil degradation by reducing the mixing of bubbles in oil.

2. Description of the Related Art

A known dry sump type engine is equipped with a blow-by gas reducing device that prevents blow-by gas, which has leaked from a space between a cylinder and a piston into a crank chamber, from being discharged to outside air (see Patent Document 1 for an example).

Here, a general blow-by gas reducing device currently in use will be described with reference to FIG. 5. In a blow-by gas reducing device 101, oil (lubricating oil) held in an oil tank 103 is pressure-fed to respective parts of an engine 102 via a lubrication passage 110 by a lubrication pump 111. Oil and blow-by gas inside an oil pan 104 is returned to the oil tank 103 via an oil gas passage 116 by an exhaust pump 106, where bubbles are separated by an air separator 107. The blow-by gas subsequently flows back to an intake pipe 112 via a backflow passage 113.

Patent Document 1: Japanese Patent Application Publication

SUMMARY OF THE INVENTION

Problems to be Solved by the Invention

However, in the above conventional blow-by gas reducing device, oil and blow-by gas are simultaneously sent to the oil tank via the oil gas passage 116. As a consequence, an exhaust pump with a large discharge rate must be adopted, which increases pump friction (mechanical loss). Also, agitation of the oil and blow-by gas inside the oil gas passage 116 increases the mixing of bubbles in the oil, which leads to the problem of accelerated oil degradation due to contact with the blow-by gas.

The present invention was devised in light of the foregoing situation, and it is an object of the present invention to provide a blow-by gas reducing device capable of adopting an exhaust pump with a small discharge rate and capable of suppressing oil degradation by reducing the mixing of bubbles in oil.

Means for Solving Problem

In a non-limiting embodiment of the present invention a blow-by gas reducing device is provided. In embodiments, the blow-by gas reducing device may include an oil pan of an engine, an oil tank, and a first communication passage that connects the oil tank and an oil holding portion of the oil pan. An oil pump may be provided in the first communication passage and pressure-feeds oil in the oil holding portion of the oil pan to the oil tank. The blow-by gas reducing device may also include a second communication passage that connects the oil tank and a blow-by gas residing portion of the engine, and a gas sending device that utilizes a flow force of oil inside the first communication passage to send blow-by gas in the blow-by gas residing portion of the engine to the oil tank via the second communication passage.

In other non-limiting embodiments, an end side of the first communication passage may be in communication with an oil holding portion of the oil tank, and an end side of the second communication passage may be in communication with an upward side of the oil holding portion of the oil tank.

In yet other non-limiting embodiments, the gas sending device may have a fan member that is provided inside the second communication passage and is rotated by the flow force of oil inside the first communication passage.

In still other non-limiting embodiments, an end side of the first communication passage may extend downward inside the oil tank.

In further non-limiting embodiments, an end side of the second communication passage may extend upward inside the oil tank.

In still further non-limiting embodiments, the gas sending device may be disposed inside the oil tank, and the fan member may be provided on an end side of the second communication passage that extends to inside the oil tank.

According to further non-limiting embodiments, the gas sending device may be disposed in the vicinity of the oil pump.

According to still further non-limiting embodiments, a baffle plate that faces an opening portion on an end side of the second communication passage may be provided inside the oil tank.

Effect of the Invention

According to the blow-by gas reducing device of the present invention, oil inside the oil pan is pressure-fed to the oil tank via the first communication passage by the oil pump. Meanwhile the blow-by gas inside the engine is sent to the oil tank via the second communication passage by the gas sending device, which utilizes the flow force of oil in the first communication passage. Thus, the flow force of oil in the first communication passage is utilized by the gas sending device to send blow-by gas inside the engine to the oil tank. Therefore, it is possible to adopt an exhaust pump with a small discharge rate and lower pump friction. In addition, the oil and the blow-by gas are separately returned to the oil tank via the first communication passage and the second communication passage. Therefore, oil degradation can be suppressed by reducing the mixing of bubbles in oil.

An end side of the first communication passage may be in communication with the oil holding portion of the oil tank, and an end side of the second communication passage may be in communication with an upward side of the oil holding portion of the oil tank. In such case, the oil can be more completely separated from the blow-by gas and sent to the oil tank. Thus, oil degradation can be further reliably suppressed by reducing the mixing of bubbles in oil.

An end side of the first communication passage may extend downward inside the oil tank. In such case, oil is sent in a direction away from the oil surface inside the oil tank, thus reducing disturbance of the oil surface and making it possible to suppress the re-incorporation of bubbles.

An end side of the second communication passage may extend upward inside the oil tank. In such case, blow-by gas is sent in a direction away from the oil surface inside the oil tank, thus reducing disturbance of the oil surface and making it possible to suppress the re-incorporation of bubbles.

If the gas sending device has a fan member that is provided inside the second communication passage and is rotated by the flow force of oil inside the first communication passage, then a suctioning force is generated by rotation of the fan member. Accordingly, blow-by gas can be suitably suctioned from the engine. Moreover, the gas sending device can achieve a simple and low-cost structure.

The gas sending device may be disposed inside the oil tank, and the fan member may be provided on an end side of the second communication passage that extends to inside the oil tank. In such case, the rotational force (centrifugal force) of the fan member scatters the blow-by gas inside the oil tank. Thus, oil mist contained in the blow-by gas can be separated. Also, even if oil leaks from the gas sending device, such oil leakage can be collected inside the oil tank.

If the baffle plate is provided facing the opening portion on an end side of the second communication passage, then blow-by gas scattered by the rotational force of the fan member hits the baffle plate. Thus, oil mist contained in the blow-by gas can be more reliably separated.

Furthermore, the gas sending device may be disposed in the vicinity of the oil pump. In such case, the flow force of oil that has just been discharged from the oil pump, i.e., oil that is almost free of passage resistance, can be utilized to send blow-by gas to the oil tank.

DESCRIPTION OF REFERENCE NUMERALS AND SIGNS

Figure 1:
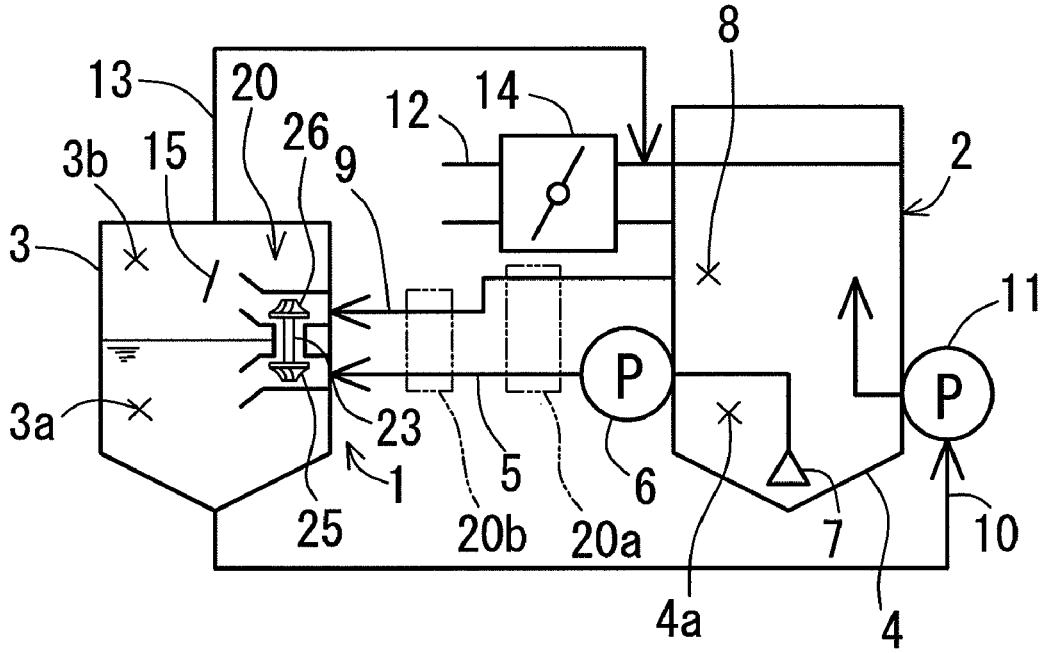
FIG. 1 is an overall circuit diagram showing a blow-by gas reducing device according to an embodiment.

1; blow-by gas reducing device, 2; engine, 3; oil tank, 3*a*; oil holding portion, 3*b*; blow-by gas residing portion, 4; oil pan, 4*a*; oil holding portion, 5; oil passage, 6; exhaust pump, 8; blow-by gas residing portion, 9; gas passage, 20, 20*a*, 20*b*; gas sending mechanism and 26, 26*a*; gas-side fan member.

DETAILED DESCRIPTION OF THE PREFERRED EMBODIMENTS

A blow-by gas reducing device according to an embodiment is structured provided with an oil pan, an oil tank, a first communication passage, an oil pump, a second communication passage, and a gas sending device.

The above-mentioned "oil pan" is not particularly limited in terms of shape, size, material and the like, provided that the oil pan can be used in a dry sump type engine.

The above-mentioned "oil tank" is not particularly limited in terms of shape, size, material and the like, provided that the oil tank is a body separate from the engine. The oil tank can conceivably be made from materials such as iron, aluminum, resin and the like.

The above-mentioned "first communication passage" is not particularly limited in terms of shape, size, material and the like, provided that the first communication passage connects the oil tank and an oil holding portion of the oil pan. The first communication passage may have an end side thereof in communication with the oil holding portion of the oil tank. In addition, an end side of the first communication passage may open facing downward and extending diagonally or generally vertically inside the oil tank, for example.

The above-mentioned "oil pump" is not particularly limited in terms of structure, form of arrangement and the like, provided that the oil pump is installed in the first communication passage and pressure-feeds oil in the oil holding portion of the oil pan to the oil tank.

The above-mentioned "second communication passage" is not particularly limited in terms of shape, size, material and the like, provided that the second communication passage connects the oil tank and a blow-by gas residing portion of the engine. The second communication passage may have an end side thereof in communication with an upward side of the oil holding portion of the oil tank (i.e., a blow-by gas residing portion of the oil tank). In addition, an end side of the second communication passage may open facing upward and extending diagonally or generally vertically inside the oil tank, for example.

Note that the above-mentioned "blow-by residing portion of the engine" is conceivably a lower portion of the cylinder, the crank chamber, upper portion of the oil pan, and the like. From the standpoint of enabling the prompt discharge of blow-by gas leaking from the space between the cylinder and the piston, another end side of the second communication passage is preferably in communication with the lower portion of the cylinder or the upper portion of the crank chamber.

The above-mentioned "gas sending device" is not particularly limited in terms of structure, form of arrangement, sending mode and the like, provided that the gas sending device utilizes a flow force of oil inside the first communication passage to send blow-by gas in the blow-by gas residing portion of the engine to the oil tank via the second communication passage.

The form of arrangement for the gas sending device conceivably includes the following: (1) a form in which the gas sending device is integrally provided with the oil tank, (2) a form in which the gas sending device is provided in the vicinity of a downstream side of the oil pump, and (3) a form in which the gas sending device is provided at a point partway in a length direction of the first and second communication passages. In the above form (1), it is easy to arrange the first and second communication passages inside an engine chamber. In the above form (2), the gas sending device may be integrally provided with the engine, for example.

The gas sending device may also have a gas sending member that is provided inside the second communication passage and is driven by the flow force of oil flowing inside the first communication passage.

Conceivable gas sending members include: (1) a fan member structuring a turbo type suction aspirator (such as a blower, a compressor, or the like), and (2) a mobile member (e.g. various rotors, pistons and so forth) structuring a displacement type suction aspirator (such as a blower, a compressor, or the like). Among these, the above form (1) is preferred from the standpoint of suitability for suctioning blow-by gas from the engine. Note that the suction aspirator of the above form (1) may also be an axial flow type, a centrifugal type, a mixed flow type, or a cross flow type. The suction aspirator of the above form (2) may also be a screw type, a vane type, a Roots type, or a reciprocating type.

In the above form (1), the fan member can be provided on an end side of the second communication passage that extends to inside the oil tank, for example. In such case, the inside of the oil tank is preferably provided with a baffle plate that faces an opening portion of the end side of the second communication passage. The baffle plate is not particularly limited in terms of shape, quantity, form of arrangement and the like, provided that blow-by gas scattered from the opening portion of the second communication passage hits the baffle plate.

Note that the gas sending device is also conceivably a form having an oil-side fan member that is provided inside the first communication passage and is rotated by oil flowing inside the first communication passage, and the above-mentioned fan member (a gas-side fan member) that is provided inside the second communication passage and is rotated by the transmission of a rotational force of the oil-side fan member. Thus, the gas sending device can achieve a more simple and low-cost structure.

The oil-side fan member is normally a fan member structuring a turbine. The turbine may be an axial flow type, a centrifugal type, a mixed flow type, or a cross flow type. Note that various types of gas-side and oil-side fan members can be selected as appropriate.

EMBODIMENTS

Hereinafter, a specific description of the present invention will be given based on embodiments with reference to the accompanying drawings.

(1) Structure of the Blow-by Gas Reducing Device

A blow-by gas reducing device 1 according to the present embodiment includes an oil tank 3 that is separate from a dry sump type engine 2 (hereinafter simply referred to as an "engine"), as shown in FIG. 1. An oil holding portion 4*a* of an oil pan 4 of the engine 2 and an oil holding portion 3*a* of the oil tank 3 are connected by an oil passage 5 (given as an example of the first communication passage according to the present invention). An end side (an engine side) of the oil passage 5 is connected to an exhaust pump 6 (given as an example of the oil pump according to the present invention) which pressure-feeds oil inside the oil pan 4 to the oil tank 3. The exhaust pump 6 is connected to an oil strainer 7 inside the oil pan 4. A blow-by gas residing portion 8 (e.g. an upper portion of a crank chamber) of the engine 2 and a blow-by gas residing portion 3*b* of the oil tank 3 are connected by a gas passage 9 (given as an example of the second communication passage according to the present invention).

The oil holding portion 3*a* of the oil tank 3 and the engine 2 are connected by a lubrication passage 10. An end side (an engine side) of the lubrication passage 10 is connected to a lubrication pump 11 that pressure-feeds oil inside the oil tank 3 to various parts of the engine 2. The blow-by gas residing portion 3*b* of the oil tank 3 and an intake pipe 12 are connected by a backflow passage 13. Note that a throttle valve 14 is provided in the intake pipe 13.

Figure 2:
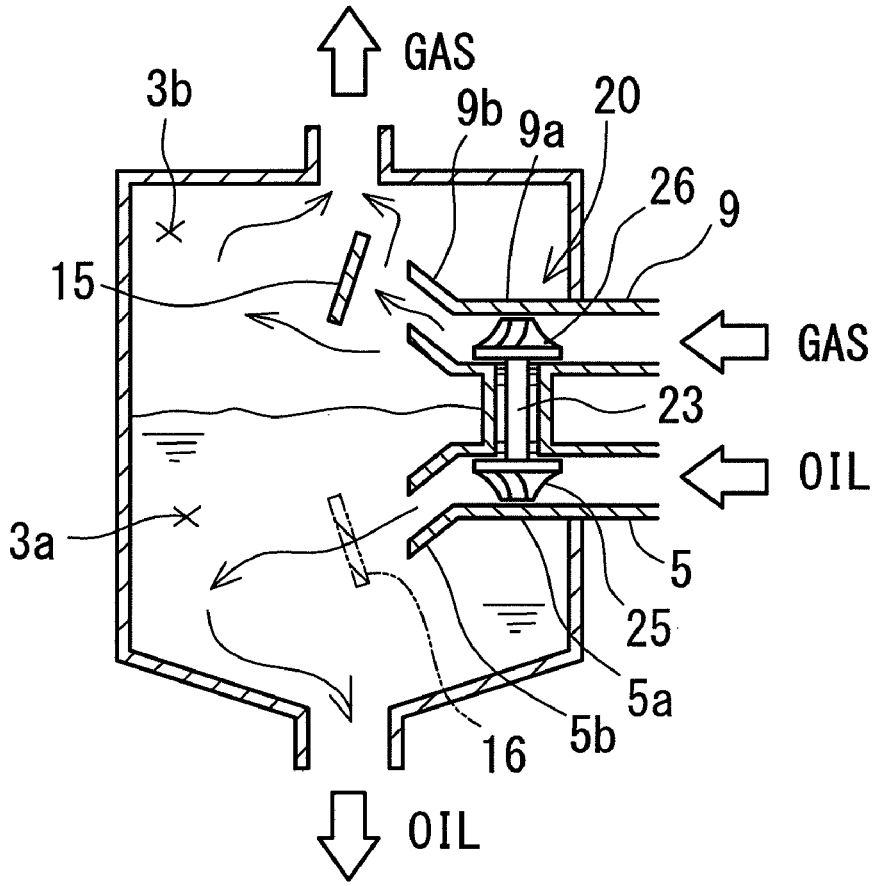
FIG. 2 is a vertical cross-sectional view of an oil tank according to the embodiment.

As FIG. 2 shows, an end side (an oil tank side) of the oil passage 5 is formed from a horizontal portion 5*a* that extends generally horizontally inside the oil tank 3, and an oblique opening portion 5*b* that continues from the horizontal portion 5*a* and extends at a downward angle inside the oil tank 3. Also, an end side (an oil tank side) of the gas passage 9 is formed from a horizontal portion 9*a* that extends generally horizontally inside the oil tank 3, and an oblique opening portion 9*b* that continues from the horizontal portion 9*a* and extends at an upward angle inside the oil tank 3. A baffle plate 15 is provided inside the oil tank 3 facing the oblique opening portion 9*b*.

Figure 3:
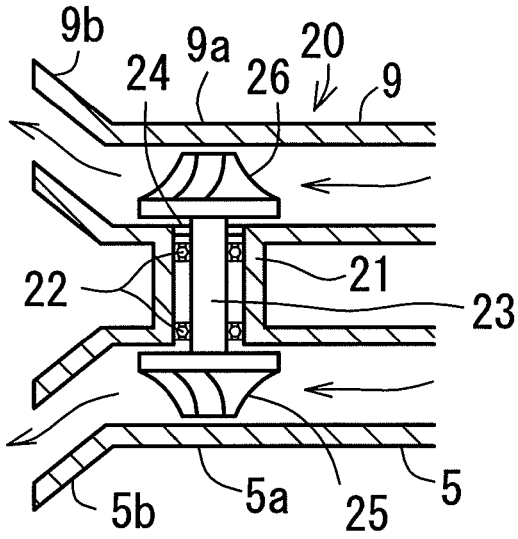
FIG. 3 is an enlarged view of an essential portion in FIG. 2.

Next, referring to FIG. 3, a gas sending mechanism 20 (given as an example of the gas sending device according to the present invention) provided inside the oil tank 3 will be described. The horizontal portion 5*a* of the oil passage 5 and the horizontal portion 9*a* of the gas passage 9 are connected by a cylindrical housing 21. Inside the housing 21, a connecting shaft 23 is rotatably supported around a vertical axis via top and bottom bearings 22. Also, an upper portion of the housing 21 is provided with an oil seal 24 for preventing the leakage of oil from an internal portion of the housing 21. A lower end side of the connecting shaft 23 is connected with an oil-side fan member 25 that is provided on the horizontal portion 5*a* of the oil passage 5. The oil-side fan member 25 structures a cross flow type turbine. An upper end side of the connecting shaft 23 is connected with a gas-side fan member 26 (given as an example of the fan member according to the present invention) that is provided on the horizontal portion 9*a* of the gas passage 9. The gas-side fan member 26 structures a cross flow type suction aspirator.

(2) Operation of the Blow-by Gas Reducing Device

The operation of the blow-by gas reducing device 1 with the above-described structure will be explained next.

As FIG. 1 shows, oil held inside the oil tank 3 is pressure-fed to various parts of the engine 2 for lubrication via the lubrication passage 10 by the lubrication pump 11. In addition, oil inside the oil pan 4 is pressure-fed to inside the oil tank 3 via the oil passage 5 by the exhaust pump 6. At such time, the oil-side fan member 25 is rotated by the oil flowing through the oil passage 5, and this rotational force is transmitted to the gas-side fan member 26 via the connecting shaft 23 so as to rotate the gas-side fan member 26. Rotation of the gas-side fan member 26 suctions the blow-by gas inside the engine 2 into the gas passage 9, after which the blow-by gas is sent to inside the oil tank 3. Note that the blow-by gas inside the oil tank 3 flows back to the intake pipe 12 via the backflow passage 13.

As FIG. 2 shows, oil sent from the oil passage 5 to inside the oil tank 3 is discharged downward at an angle from the oblique opening portion 5*b* away from the oil surface. Meanwhile, gas sent from the gas passage 9 to inside the oil tank 3 scatters upward at an angle from the oblique opening portion 9*b* away from the oil surface due to the rotational force (centrifugal force) of the gas-side fan member 26. Such scattering causes the separation of oil mist contained in the gas. In addition, a majority of the scattered gas hits the baffle plate 15. The oil mist contained in the gas falls along the baffle plate 15 and is collected in the oil holding portion 3*a*.

(3) Effects of the Embodiment

According to the blow-by gas reducing device 1 of the present embodiment, the flow force of oil flowing through the oil passage 5 is utilized by the gas sending mechanism 20 to send blow-by gas inside the engine 2 to the oil tank 3. Therefore, it is possible to adopt the exhaust pump 6 with a small discharge rate and lower pump friction. In addition, the oil and the blow-by gas are separately returned to the oil tank 3 via the oil passage 5 and the gas passage 9. Therefore, oil degradation can be suppressed by reducing the mixing of bubbles in oil.

In the present embodiment, an end side of the oil passage is in communication with the oil holding portion 3*a* of the oil tank 3, and an end side of the gas passage 9 is in communication with the blow-by gas residing portion 3*b* of the oil tank 3. Therefore, the oil can be more completely separated from the blow-by gas and sent to the oil tank 3. Thus, oil degradation can be further reliably suppressed by reducing the mixing of bubbles in oil.

In the present embodiment, an end side of the oil passage 5 is provided with the oblique opening portion 5*b*. Therefore, oil is sent in a direction away from the oil surface inside the oil tank 3, thus reducing disturbance of the oil surface and making it possible to suppress the re-incorporation of bubbles. An end side of the gas passage 9 is provided with the oblique opening portion 9*b*. Therefore, blow-by gas is sent in a direction away from the oil surface inside the oil tank 3, thus reducing disturbance of the oil surface and making it possible to suppress the re-incorporation of bubbles.

The present embodiment adopts the gas sending mechanism 20 equipped with the oil-side fan member 25 provided inside the oil passage 5, the gas-side fan member 26 provided inside the gas passage 9, and the connecting shaft 23 that connects the oil-side and gas-side fan members 25 and 26. Therefore, the gas sending mechanism 20 can achieve an extremely simple and low-cost structure.

In the present embodiment, the gas sending mechanism 20 is provided inside the oil tank 3, the gas-side fan member 26 is provided on the horizontal portion 9*a* of the gas passage 9 extending to inside the oil tank 3, and the oil-side fan member 25 is provided on the horizontal portion 5*a* of the oil passage 5 extending to inside the oil tank 3. Therefore, the rotational force (centrifugal force) of the gas-side fan member 26 scatters the blow-by gas inside the oil tank 3. Thus, oil mist contained in the blow-by gas can be separated. Also, even if oil leaks from the housing 21 of the gas sending mechanism 20, such oil leakage can be collected inside the oil tank 3. Moreover, a discharge force of the exhaust pump 6 is used as the rotational force of the oil-side fan member 25. Therefore, the force by which oil is discharged can be weakened as appropriate by the oil-side fan member 25. Disturbances of the oil surface caused by such discharged oil can thus be reduced, and consequently, re-incorporation of bubbles inside the oil tank 3 can be suppressed.

According to the present embodiment, the baffle plate 15 is provided facing the oblique opening portion 9*b* on an end side of the gas passage 9 in the oil tank 3. Therefore, blow-by gas scattered by the rotational force of the gas-side fan member 26 hits the baffle plate 15. Thus, oil mist contained in the blow-by gas can be more reliably separated.

It should be noted that the present invention is not limited to the embodiment described above, and various modifications depending on the purpose and application are possible that fall within the scope of the present invention. Namely, in the above embodiment, an example of a form was given where the gas sending mechanism 20 is disposed inside the oil tank. However, the present invention is not limited to this, and as shown by imaginary lines in FIG. 1 for example, a gas sending mechanism 20*a* may be provided in the vicinity of a downstream side of the exhaust pump 6, and a gas sending mechanism 20*b* may be provided at a point partway in the length direction of the oil passage 5 and the gas passage 9.

According to the above embodiment, an end side of the oil passage 5 is formed from the horizontal portion 5*a* and the oblique opening portion 5*b*. However, the present invention is not limited to this, and an end side of the oil passage may be formed from only the horizontal portion, or formed from the horizontal portion and a vertical opening portion continuing therefrom, for example. Also, an end side of the gas passage 9 is formed from the horizontal portion 9*a* and the oblique opening portion 9*b*. However, the present invention is not limited to this, and an end side of the gas passage may be formed from only the horizontal portion, or formed from the horizontal portion and a vertical opening portion continuing therefrom, for example.

Figure 4:
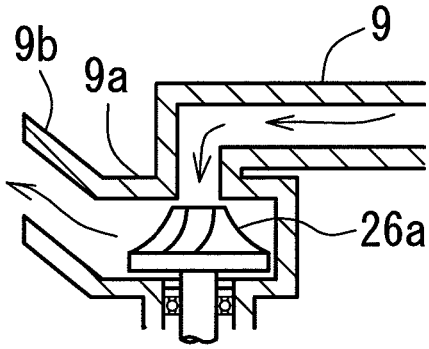
FIG. 4 is a vertical cross-sectional view showing another embodiment of a gas-side fan member.
Figure 5:
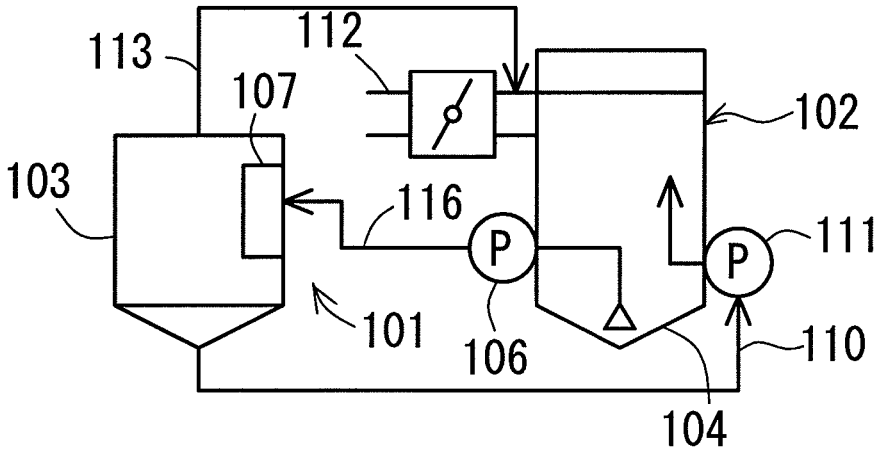
FIG. 5 is an overall circuit diagram showing a blow-by gas reducing device according to related art.

In the above embodiment, an example was given of the gas-side fan member 26 structuring a cross flow type suction aspirator. However, the present invention is not limited to this, and a gas-side fan member 26*a* (see FIG. 4) structuring a centrifugal type suction aspirator, or a gas-side fan member structuring an axial flow type or a mixed flow type suction aspirator may be used. Furthermore, in the above embodiment, an example was given of the oil-side fan member 25 structuring a cross flow type turbine. However, the present invention is not limited to this, and an oil-side fan member structuring a centrifugal type, a mixed flow type, or an axial flow type turbine may be used.

As shown by an imaginary line in FIG. 2, a baffle plate 16 may also be provided facing the oblique opening portion 9*b* of the oil passage 9 inside the oil tank 3 in the above embodiment.

INDUSTRIAL APPLICABILITY

The present invention can be widely utilized as art for reducing blow-by gas in a dry sump type engine.

What is claimed is:

1. A blow-by gas reducing device comprising:

an oil pan of an engine;

an oil tank;

a first communication passage that connects said oil tank and an oil holding portion of said oil pan;

an oil pump that is provided in said first communication passage and pressure-feeds oil in said oil holding portion of said oil pan to said oil tank;

a second communication passage that connects said oil tank and a blow-by gas residing portion of said engine; and a gas sending device that utilizes a flow force of oil inside said first communication passage to send blow-by gas in said blow-by gas residing portion of said engine to said oil tank via said second communication passage.

2. The blow-by gas reducing device according to claim 1, wherein an end side of said first communication passage is in communication with an oil holding portion of said oil tank, and an end side of said second communication passage is in communication with an upward side of said oil holding portion of said oil tank.

3. The blow-by gas reducing device according to claim 1, wherein said gas sending device has a fan member that is provided inside said second communication passage and is rotated by the flow force of oil inside said first communication passage.

4. The blow-by gas reducing device according to claim 2, wherein an end side of said first communication passage extends downward inside said oil tank.

5. The blow-by gas reducing device according to claim 2, wherein an end side of said second communication passage extends upward inside said oil tank.

6. The blow-by gas reducing device according to claim 2, wherein said gas sending device has a fan member that is provided inside said second communication passage and is rotated by the flow force of oil inside said first communication passage.

7. The blow-by gas reducing device according to claim 3, wherein said gas sending device is disposed inside said oil tank, and said fan member is provided on an end side of said second communication passage that extends to inside said oil tank.

8. The blow-by gas reducing device according to claim 3, wherein said gas sending device is disposed in the vicinity of said oil pump.

9. The blow-by gas reducing device according to claim 4, wherein an end side of said second communication passage extends upward inside said oil tank.

10. The blow-by gas reducing device according to claim 4, wherein said gas sending device has a fan member that is provided inside said second communication passage and is rotated by the flow force of oil inside said first communication passage.

11. The blow-by gas reducing device according to claim 5, wherein said gas sending device has a fan member that is provided inside said second communication passage and is rotated by the flow force of oil inside said first communication passage.

12. The blow-by gas reducing device according to claim 6, wherein said gas sending device is disposed inside said oil tank, and said fan member is provided on an end side of said second communication passage that extends to inside said oil tank.

13. The blow-by gas reducing device according to claim 7, wherein a baffle plate that faces an opening portion on an end side of said second communication passage is provided inside said oil tank.

14. The blow-by gas reducing device according to claim 9, wherein said gas sending device has a fan member that is provided inside said second communication passage and is rotated by the flow force of oil inside said first communication passage.

15. The blow-by gas reducing device according to claim 10, wherein said gas sending device is disposed inside said oil tank, and said fan member is provided on an end side of said second communication passage that extends to inside said oil tank.

16. The blow-by gas reducing device according to claim 11, wherein said gas sending device is disposed inside said oil tank, and said fan member is provided on an end side of said second communication passage that extends to inside said oil tank.

17. The blow-by gas reducing device according to claim 12, wherein a baffle plate that faces an opening portion on an end side of said second communication passage is provided inside said oil tank.

18. The blow-by gas reducing device according to claim 14, wherein said gas sending device is disposed inside said oil tank, and said fan member is provided on an end side of said second communication passage that extends to inside said oil tank.

19. The blow-by gas reducing device according to claim 14, wherein said gas sending device is disposed in the vicinity of said oil pump.

20. The blow-by gas reducing device according to claim 18, wherein a baffle plate that faces an opening portion on an end side of said second communication passage is provided inside said oil tank.

* * * * *